US011041625B2

(12) United States Patent
Purcell et al.

(10) Patent No.: US 11,041,625 B2
(45) Date of Patent: Jun. 22, 2021

(54) FUEL NOZZLE WITH NARROW-BAND ACOUSTIC DAMPER

(71) Applicant: General Electric Company, Schenectady, NY (US)

(72) Inventors: Timothy James Purcell, Greenville, SC (US); Bruno Schuermans, La Tour de Peilz (CH); Lucas John Stoia, Taylors, SC (US); Sven Georg Bethke, Greenville, SC (US)

(73) Assignee: General Electric Company, Schenectady, NY (US)

( * ) Notice: Subject to any disclaimer, the term of this patent is extended or adjusted under 35 U.S.C. 154(b) by 206 days.

(21) Appl. No.: 15/381,735

(22) Filed: Dec. 16, 2016

(65) Prior Publication Data

US 2018/0172273 A1 Jun. 21, 2018

(51) Int. Cl.
*F23R 3/28* (2006.01)

(52) U.S. Cl.
CPC .... *F23R 3/286* (2013.01); *F23R 2900/00014* (2013.01)

(58) Field of Classification Search
CPC .. F23R 3/28; F23R 3/283; F23R 3/286; F23R 2900/00014; F05D 2260/96; F05D 2260/963; F05D 2260/964; F05D 2270/14
See application file for complete search history.

(56) References Cited

U.S. PATENT DOCUMENTS

| | | | | |
|---|---|---|---|---|
| 4,409,787 | A | 10/1983 | Davi et al. | |
| 5,644,918 | A | 7/1997 | Gulati et al. | |
| 5,685,157 | A | 11/1997 | Pandalai et al. | |
| 8,567,197 | B2 * | 10/2013 | Mueller | F23R 3/00 60/722 |
| 8,789,372 | B2 * | 7/2014 | Johnson | F23R 3/28 60/725 |
| 9,033,699 | B2 | 5/2015 | Stoia et al. | |
| 9,163,839 | B2 | 10/2015 | Westmoreland et al. | |
| 9,249,734 | B2 | 2/2016 | Melton et al. | |
| 9,506,654 | B2 | 11/2016 | Uhm et al. | |
| 2012/0137690 | A1 * | 6/2012 | Sardeshmukh | F23R 3/002 60/725 |
| 2014/0013756 | A1 * | 1/2014 | Melton | F02C 7/22 60/725 |

FOREIGN PATENT DOCUMENTS

| | | | | |
|---|---|---|---|---|
| EP | 2397759 | A1 * | 12/2011 | F23R 3/002 |
| WO | WO2015/023733 | A1 | 2/2015 | |
| WO | WO 2015023733 | A1 * | 2/2015 | F23R 3/002 |

OTHER PUBLICATIONS

Field and Fricke, "Theory and Applications of Quarter-wave Resonators: A Prelude to Their Use for Attenuating Noise Entering Buildings Through Ventilation Openings", 1997-98, Elsevier Science Ltd., Applied Acoustics, vol. 53, No. 1-3, pp. 117-132, 1998.*

* cited by examiner

*Primary Examiner* — Gerald L Sung
*Assistant Examiner* — Stephanie Sebasco Cheng
(74) *Attorney, Agent, or Firm* — Dority & Manning, P.A.

(57) ABSTRACT

A fuel nozzle assembly includes a fuel plenum for delivering fuel to a combustion zone of a combustor. At least one narrow-band acoustic damper is provided in the fuel nozzle assembly. The narrow-band acoustic damper is tuned to dampen pressure oscillations within the combustor. The narrow-band acoustic damper may be a quarter-wave tube mounted to a cap plate within or adjacent to the fuel nozzle assembly.

16 Claims, 7 Drawing Sheets

FUEL NOZZLE WITH NARROW-BAND ACOUSTIC DAMPER

FIELD

The present invention generally involves a bundled tube type fuel nozzle assembly for a gas turbine combustor. More specifically, the invention relates to a bundled tube type fuel nozzle assembly with a narrow-band acoustic damper incorporated therein.

BACKGROUND

Particular combustion systems for gas turbine engines utilize combustors which burn a gaseous or liquid fuel mixed with compressed air. Generally, a combustor includes a fuel nozzle assembly including multiple fuel nozzles which extend downstream from an end cover of the combustor and which provide a mixture of fuel and compressed air to a primary combustion zone or chamber. A combustor may have bundled tube type fuel nozzles for premixing a fuel with compressed air upstream from the combustion zone. A bundled tube type fuel nozzle assembly generally includes multiple tubes that extend through a fuel plenum body which is at least partially defined by a forward plate, an aft plate and an outer sleeve. Compressed air flows into an inlet portion of each tube. Fuel from the fuel plenum is injected into each tube where it premixes with the compressed air before it is routed into the combustion zone.

During operation, various operating parameters such as fuel temperature, fuel composition, ambient operating conditions and/or operational load on the gas turbine may result in combustion dynamics or pressure pulses within the combustor. The combustion dynamics may cause oscillation of various combustor hardware components such as the liner and/or the fuel nozzle which may result in undesirable wear of those components. Alternately, or in addition, high frequencies of combustion dynamics may produce pressure pulses inside the premixer tubes and/or combustion chamber that affect the stability of the combustion flame, reduce the design margins for flashback or flame holding, and/or increase undesirable emissions.

BRIEF DESCRIPTION

Aspects and advantages are set forth below in the following description, or may be obvious from the description, or may be learned through practice.

One embodiment of the present disclosure is a bundled tube fuel nozzle assembly. The fuel nozzle assembly includes a fuel plenum body including a forward plate extending in a radial direction, an aft plate axially spaced from the forward plate and extending in a radial direction, an outer sleeve extending in an axial direction between the forward plate and the aft plate, and a fuel plenum defined by the forward plate, the aft plate and the outer sleeve. A fuel conduit is in fluid communication with the fuel plenum. The fuel nozzle assembly further includes a plurality of mixing tubes extending through the fuel plenum body. Each of the mixing tubes includes an air inlet, a fuel port in fluid communication with the fuel plenum, and an outlet downstream of the aft plate. The fuel nozzle assembly also includes a cap plate axially spaced from the aft plate with an air plenum defined between the aft plate and the cap plate, the cap plate being upstream of a combustion zone and including a hot surface facing the combustion zone. The fuel nozzle assembly also includes a narrow-band acoustic damper located within the air plenum.

Another embodiment of the present disclosure is a gas turbine including a compressor, a turbine, and a combustor disposed downstream from the compressor and upstream from the turbine. The combustor includes an end cover coupled to an outer casing and a bundled tube fuel nozzle assembly disposed within the outer casing and coupled to the end cover, the bundled tube fuel nozzle assembly being located upstream of a combustion zone. The bundled tube fuel nozzle assembly includes a fuel plenum body including a forward plate extending in a radial direction, an aft plate axially spaced from the forward plate and extending in a radial direction, an outer sleeve extending in an axial direction between the forward plate and the aft plate, and a fuel plenum defined by the forward plate, the aft plate and the outer sleeve. A fuel conduit is in fluid communication with the fuel plenum. The fuel nozzle assembly also includes a cap plate axially spaced from the aft plate with an air plenum defined between the aft plate and the cap plate, the cap plate including a hot surface facing the combustion zone. The fuel nozzle assembly further includes a plurality of mixing tubes extending through the fuel plenum body. Each of the mixing tubes includes an air inlet, an outlet downstream of the aft plate, and a fuel port in fluid communication with the fuel plenum. The fuel nozzle assembly also includes a narrow-band acoustic damper located within the air plenum.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
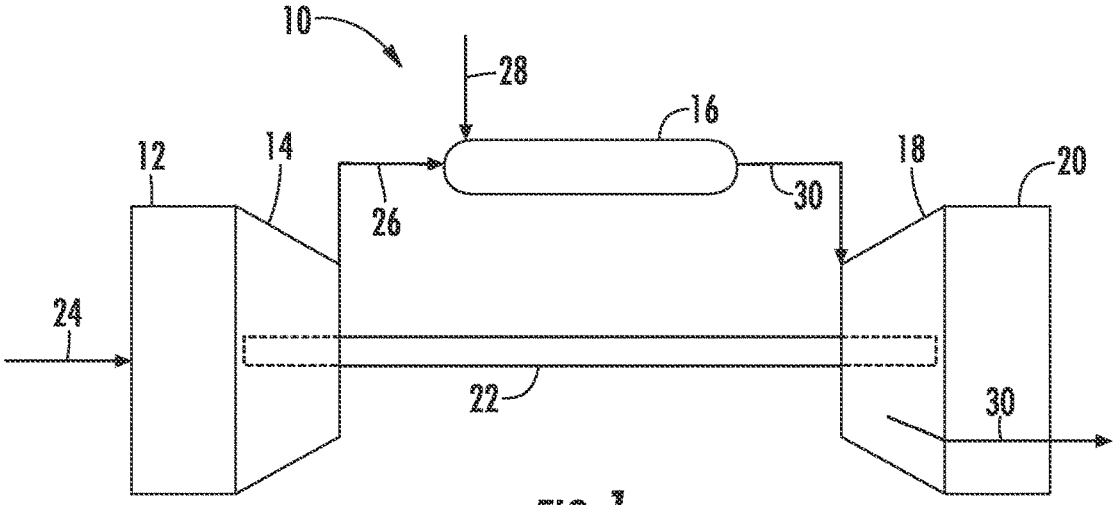
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Although exemplary embodiments of the present disclosure will be described generally in the context of a fuel nozzle assembly for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
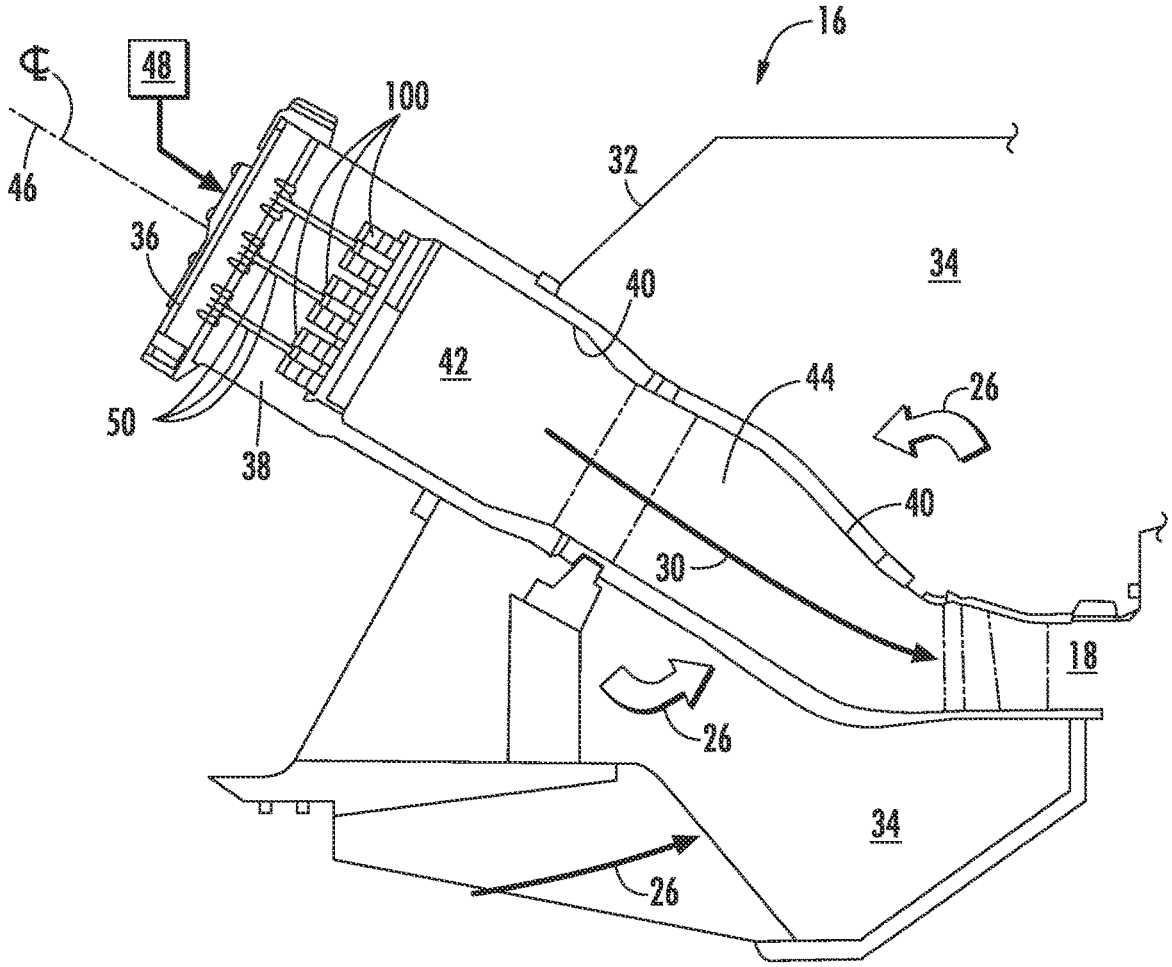
FIG. 2 is a simplified longitudinal section view of an exemplary combustor as may incorporate various embodiments of the present disclosure.

As shown in FIG. 2, the combustor 16 may be at least partially surrounded by an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive compressed air 26 therefrom. An end cover 36 may be coupled to the outer casing 32. In particular embodiments, the outer casing 32 and the end cover 36 may at least partially define a head end volume or portion 38 of the combustor 16.

In particular embodiments, the head end portion 38 is in fluid communication with the high pressure plenum 34 and/or the compressor 14. One or more liners or ducts 40 may at least partially define a combustion chamber or zone 42 for combusting the fuel-air mixture and/or may at least partially define a hot gas path 44 through the combustor 16 for directing the combustion gases 30 towards an inlet to the turbine 18.

In various embodiments, the combustor 16 includes at least one bundled tube type fuel nozzle assembly 100. As shown in FIG. 2, the fuel nozzle assembly 100 is disposed within the outer casing 32 downstream from and/or axially spaced from the end cover 36 with respect to axial centerline 46 of the combustor 16 and upstream from the combustion chamber 42. In particular embodiments, the fuel nozzle assembly 100 is in fluid communication with a fuel supply 48 via one or more fluid conduits 50. In particular embodiments, the fluid conduit(s) 50 may be fluidly coupled and/or connected at one end to the end cover 36. It should be understood that the fuel nozzle assemblies 100 and/or the fluid conduit(s) may be mounted to structures other than the end cover 36 (e.g., the outer casing 32).

Figure 3:
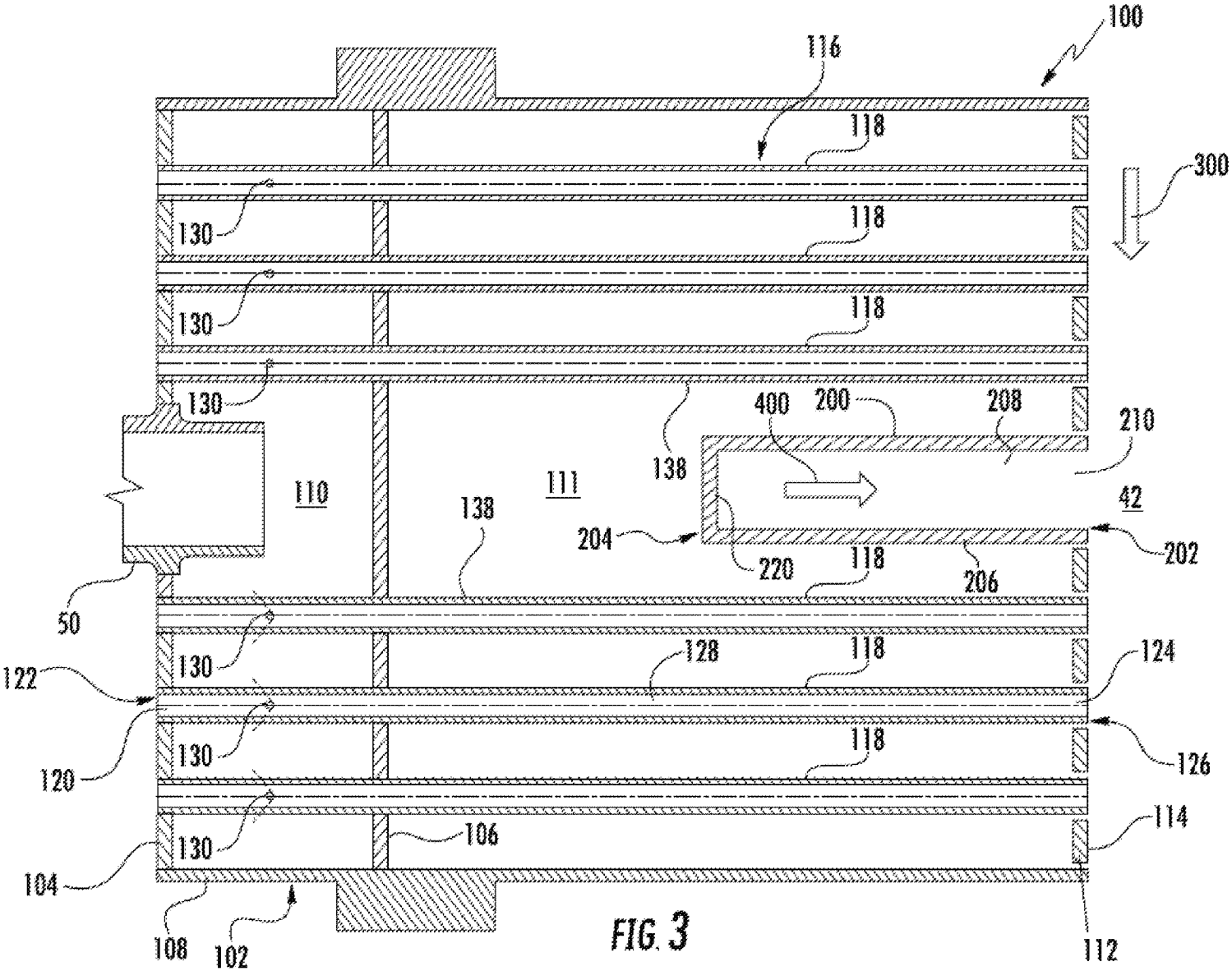
FIG. 3 is a longitudinal section view of a portion of an exemplary bundled tube type fuel nozzle assembly as shown in FIG. 2, according to at least one embodiment of the present disclosure.
Figure 4:
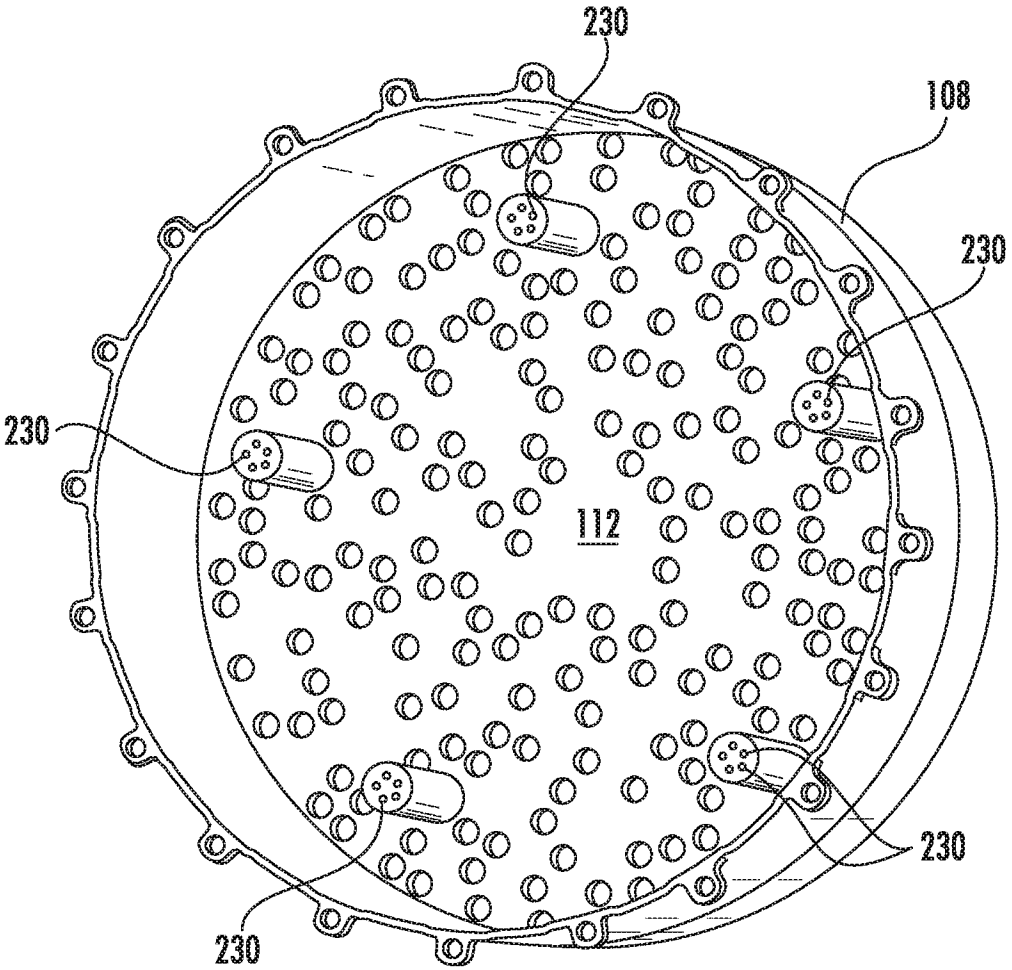
FIG. 4 is a perspective view of a portion of an exemplary fuel nozzle assembly, according to at least one embodiment of the present disclosure.

FIG. 3 provides a longitudinal section view of a portion of an exemplary fuel nozzle assembly 100 as shown in FIG. 2, according to at least one embodiment of the present disclosure. As will be discussed in more detail below, various embodiments of the combustor 16 may include different arrangements of the fuel nozzle assembly 100 and is not limited to any particular arrangement unless otherwise specified. For example, in particular configurations as illustrated in FIGS. 2 and 4, the fuel nozzle assembly 100 includes multiple wedge shaped fuel nozzle segments annularly arranged about centerline 46. In some embodiments, e.g., as illustrated in FIGS. 4 and 8, the fuel nozzle assembly 100 may further include a circular shaped fuel nozzle segment centered on the centerline 46. In particular embodiments, the fuel nozzle assembly 100 may form an annulus or fuel nozzle passage about a center fuel nozzle 50. Alternately, the fuel nozzle segments may be arranged in virtually any shape, such as circular (shown in FIG. 7), triangular, square, or oval, and may be arranged in various geometries in the fuel nozzle assembly 100.

In at least one embodiment, as shown in FIG. 3, the fuel nozzle assembly 100 and/or each fuel nozzle segment includes a fuel plenum body 102 having a forward or upstream plate 104, an aft plate 106 axially spaced from the forward plate 104 and an outer band or sleeve 108 that extends axially between the forward plate 104 and the aft plate 106. A fuel plenum 110 is defined within the fuel plenum body 102. In particular embodiments, the forward plate 104, the aft plate 106 and the outer sleeve 108 may at least partially define the fuel plenum 110. In particular embodiments, the fluid conduit 50 may extend through the forward plate 104 to provide fuel to the fuel plenum 110. In various embodiments, the fuel nozzle assembly 100 includes a cap plate 112 axially spaced from the aft plate 106. An air plenum 111 is defined between the aft plate 106 and cap plate 112. A hot side 114 of the cap plate 112 is generally disposed adjacent or proximate to the combustion chamber 42.

As shown in FIG. 3, the fuel nozzle assembly 100 includes a tube bundle 116 comprising a plurality of tubes 118. Each tube 118 extends through the forward plate 104, the fuel plenum 110, the aft plate 106, the air plenum 111, and the cap plate 112. The tubes 118 are fixedly connected to and/or form a seal against the aft plate 106. For example, the tubes 118 may be welded, brazed or otherwise connected to the aft plate 106. Each tube 118 includes an air inlet 120 defined at an upstream end 122 of each respective tube 118 and an outlet 124 defined at a downstream end 126 of each respective tube 118. The downstream end portion 126 extends through a corresponding tube opening in the cap plate 112, the tube opening being sized to define a circumferentially continuous radial gap between an outer surface of the tube 118 and an inner surface of the corresponding tube opening. The circumferentially continuous radial gap permits compressed air 26 to flow around the tube from the air plenum 111 towards the combustion chamber 42, thereby cooling the downstream end portions 126 of the tubes 118.

Each tube 118 defines a respective premix flow passage 128 through the fuel nozzle assembly 100, for premixing the fuel 28 (FIG. 1) with the compressed air 26 (FIG. 1) within mixing tube 118 before it is directed into a combustion zone 42 defined downstream from the fuel nozzle assembly 100. In particular embodiments, one or more tubes 118 of the plurality of tubes 118 is in fluid communication with the fuel plenum 110 via one or more fuel ports 130 defined within the respective tube(s) 118, which openings 130 may be defined in a wall 138 of the mixing tube 118.

As described above, the downstream end portions 126 of tubes 118 are not attached at the cap plate 112. During operation, combustion dynamics may cause oscillations of the various parts of the combustor 16, which in turn may impact one another. For example, the cantilevered tubes 118, particularly the downstream end portion 126 of each tube 118, may move radially with respect to a centerline of each respective tube 118 resulting in contact between the tubes 118 and the corresponding tube openings in the cap plate 112. As another example, the fuel nozzle assembly 100 may impact the liner 40 of the combustor 16. As yet another example, the fuel nozzle assembly 100 or other parts within the head end 38 may impact the outer casing 32 and/or the end cover 36. Such impacts may cause undesirable wear on the various parts due to the physical force of the impact and/or increased thermal loading on upstream components of the combustor 16. For example, the combustion gases 30 (FIG. 1) may create an elevated temperature in the downstream end portion 126 of each tube 118 such that impact of the tubes 118 on the cap plate 112 may increase thermal loading of the cap plate 112.

Figure 5:
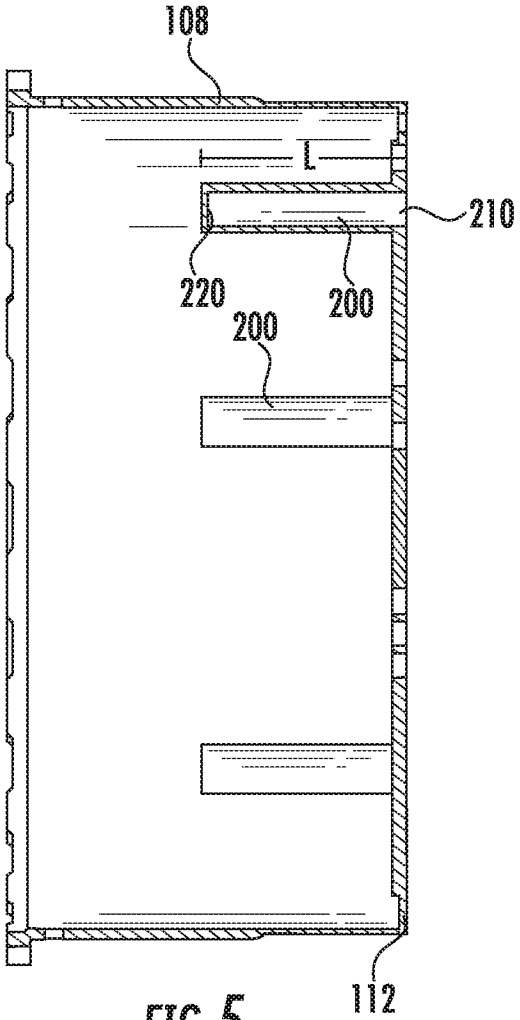
FIG. 5 is a longitudinal section view of the portion of the exemplary fuel nozzle assembly of FIG. 4, according to at least one embodiment of the present disclosure.

In various embodiments of the present disclosure, as shown in FIG. 3, the fuel nozzle assembly 100 includes one or more narrow-band acoustic dampers 200 disposed in air plenum 111 between the aft plate 106 and the cap plate 112. In particular exemplary embodiments, the narrow-band acoustic dampers 200 may be provided as quarter-wave tubes 200. In some embodiments, for example as illustrated in FIG. 3, the quarter-wave tube 200 may extend between an entrance 210 at an aft end 202 of the quarter-wave tube 200 and a reflective plane 220 at a forward end 204 of the quarter-wave tube 200 over a distance L (FIG. 5). The length L of the quarter-wave tube 200 may be defined by the distance between the entrance 210 and the reflective plane 220. In some embodiments, the quarter-wave tube 200 may extend generally along the axial direction. As such, the quarter-wave tube 200 may be generally aligned with the flow of fuel 28 and/or compressed air 26 through the fuel nozzle assembly 100. In some embodiments, the quarter-wave tube 200 defines an internal volume 208 between the entrance 210 and the reflective plane 220 and bounded by wall(s) 206.

In some embodiments, e.g., as illustrated in FIG. 3, the quarter-wave tube 200 may extend through the cap plate 112. In exemplary embodiments, the quarter-wave tube 200 may extend through the cap plate 112 such that the entrance 210 of the quarter-wave tube 200 is flush with the hot surface 114 of the cap plate 112.

Figure 9:
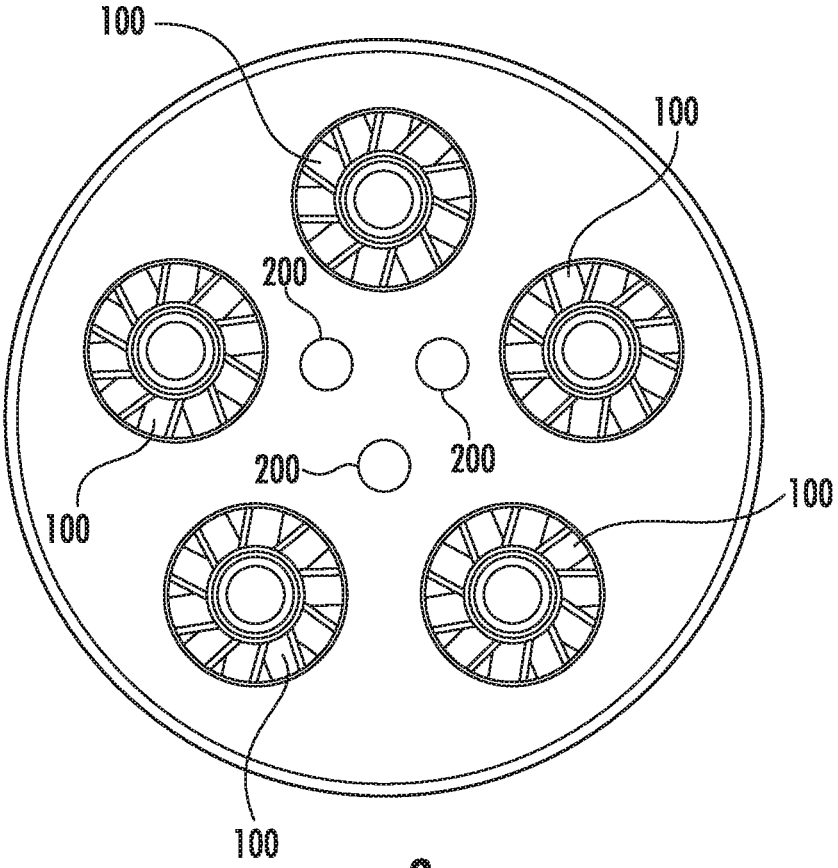
FIG. 9 is an end view of an exemplary fuel nozzle assembly, according to at least one embodiment of the present disclosure.

The quarter-wave tube 200 may be tuned to dampen a particular frequency based on the internal volume and length of the quarter-wave tube 200 and, in some embodiments, purge flow through purge holes 230 (FIG. 4). For example, the quarter-wave tube 200 may be tuned based on the relationship between the length L of the quarter-wave tube 200 and the wavelength $\lambda$, of the oscillation to be damped. The distance L between the entrance 210 and the reflective plane 220 may be around one quarter of the target wavelength ($\lambda/4$), such that an incident wave 300 entering the quarter-wave tube 200 at the entrance 210 travels from the entrance 210 to the reflective plane 220 over a distance of $\lambda/4$, and the reflected wave 400 travels from reflective plane 220 to entrance 210 over another distance of $\lambda/4$ for a total travel distance of $\lambda/2$. Thus, as illustrated in FIG. 9, the reflected wave 400 is shifted a total of $\lambda/2$ with respect to the incident wave 300. In other words, the reflected wave 400 is one hundred eighty degrees (180°) or pi radians ($\pi$ rad) out of phase with the incident wave 300, effectively cancelling out the incident wave 300 (e.g., where the resultant wave from combining the incident wave 300 and the reflected wave 400 has an amplitude of about zero) and thus mitigating vibration at the selected frequency.

Such quarter-wave tubes 200 may be tuned to dampen any particular range of frequencies as needed. In one possible, non-limiting example, the quarter-wave tube 200 may be tuned to dampen a frequency range from about nine hundred Hertz (900 Hz) to about eleven hundred hertz (or 1.1 kHz). As used herein, "about" generally means within approximately ten percent (10%) more or less than a stated value. For example, about 1.1 kHz could include from 990 Hz to 1210 Hz.

As another example, an amplitude of about zero means that the amplitude of the resultant wave is significantly smaller than the incident wave 300, such that it may be negligible as compared to the amplitude of incident wave 300. In some embodiments, the amplitude of the resultant wave may be reduced sufficiently to avoid or minimize harmonic resonance in the combustor 16, i.e., the narrow-band acoustic dampers 200 may be tuned to dampen a resonant frequency of the combustor 16. For example, the length L of the quarter-wave tube 200 may correspond to one-quarter of the wavelength of the resonant frequency of the combustor 16 such that the quarter-wave tube 200 is tuned to dampen the resonant frequency. As such, the quarter-wave tube 200 may serve to avoid or minimize oscillations such as described above.

During operation, pressure waves 300 may form in the combustion chamber 42, as shown in FIG. 3. Such waves 300 may propagate circumferentially around the combustor 16, e.g., in a vertical direction in the view provided in FIG. 3. The quarter-wave tube 200 may be disposed tangential to the direction of travel of the wave 300, and in some embodiments, may be orthogonal to the direction of travel of the wave 300. When a pressure wave 300 travelling around the combustor 16 encounters the quarter-wave tube 200, a portion of the wave 300 is diverted into the quarter-wave tube 200, travels down quarter-wave tube 200, and impedes on the reflective plane 220, as described above, such that the frequency of the reflected wave 400 returning from the reflective plane 220 of the quarter-wave tube 200 is shifted as shown in FIG. 9. As a result, the pressure wave 300 may be damped by the quarter-wave tube 200.

In some embodiments, for example as illustrated in FIGS. 3 & 5, the entrance 210 of the quarter-wave tube 200 may be open and completely unobstructed. For example, no perforated plate or other flow control device may be provided in or near entrance 210 of the quarter-wave tube 200. In such embodiments, the quarter-wave tube 200 is completely open to the combustion zone 42 to effectively damp the target frequency of combustion dynamics. Additionally, in at least one exemplary embodiment, the entrance 210 of the quarter-wave tube 200 permits unobstructed flow between the internal volume 208 and the combustion zone 42. Further, in such embodiments, the quarter-wave tube 200 may be located upstream of the combustion zone 42 which may avoid or minimize exposure of the quarter-wave tube 200 to excessive thermal load.

As may be seen for example in FIG. 3, some embodiments include the quarter-wave tube 200 located on a "bald spot" of the cap plate 112 that is radially aligned with the fuel conduit 50 and axially aft of the fuel conduit 50. Such location may be referred to as a "bald spot" in the cap plate 112 in that it is generally unoccupied by the mixing tubes 118. In some embodiments, for example as shown in FIGS. 3 and 5, the quarter-wave tube 200 may be cantilevered from the cap plate 112. In some embodiments, the quarter-wave tube 200 may be made from one-piece bar stock, which may reduce the mass overhung by the cantilevered construction. In other embodiments, the quarter-wave tube 200 may be integrally formed with cap plate 112, such as by manufacturing both parts as one piece, e.g., using additive manufacturing techniques such as direct metal laser melting, selective laser sintering, or other suitable techniques. It is also possible within the scope of the present subject matter to form the quarter-wave tube 200 and attach it to the cap plate 112 by other suitable methods, such as welding or brazing a cast or fabricated quarter-wave tube 200 to the cap plate 112.

FIG. 4 is a partial perspective view according to at least one exemplary embodiment of the cap plate 112 and at least a portion of the outer shroud 108. FIG. 5 is a section view of the cap plate 112, the partial outer shroud 108, and the quarter-wave tube 200 of FIG. 4. Other portions of the fuel nozzle assembly 100, such as the mixing tubes 118, are omitted for clarity of illustration in FIGS. 4 and 5 for illustrative purposes only. As may be seen for example in FIG. 4, in some embodiments, the forward end 204 of the quarter-wave tube 200 may be provided with small purge holes 230 through the plate defining the reflective plane 220. Purge holes 230 are defined in the forward end 204 of the quarter wave tube 200 and are configured to permit air from the air plenum 111 to flow through the quarter-wave tube 200. As such, the purge holes 230 may provide a purge flow through the quarter-wave tube 200 from the forward end 204 to the aft end 202. Additionally, the purge holes 230 may serve to cool the quarter-wave tube 200. While shown as being located opposite the opening 210 of the quarter-wave tube 200, it is contemplated herein that the purge holes 230 may be located in the wall 206 defining the tube 200, additional to, or instead of, the plate defining the reflective plane 220.

In some exemplary embodiments, the fuel nozzle assembly may include wedge-shaped segments arranged radially around the combustor centerline 46, which may or may not include a central circular fuel nozzle segment. As illustrated in FIG. 4, five wedge-shaped segments may be arranged radially around a central circular segment. In this embodiment, five quarter-wave tubes 200 may be provided. That is, each wedge-shaped segment may have a quarter-wave tube 200 provided therein, e.g., in a location aligned with a fuel conduit 50 (not shown in FIG. 4, see, e.g., FIG. 3) associated with each respective wedge-shaped segment. Alternately, the number of quarter-wave tubes 200 may be greater than or less than the number of fuel nozzle segments.

Figure 6:
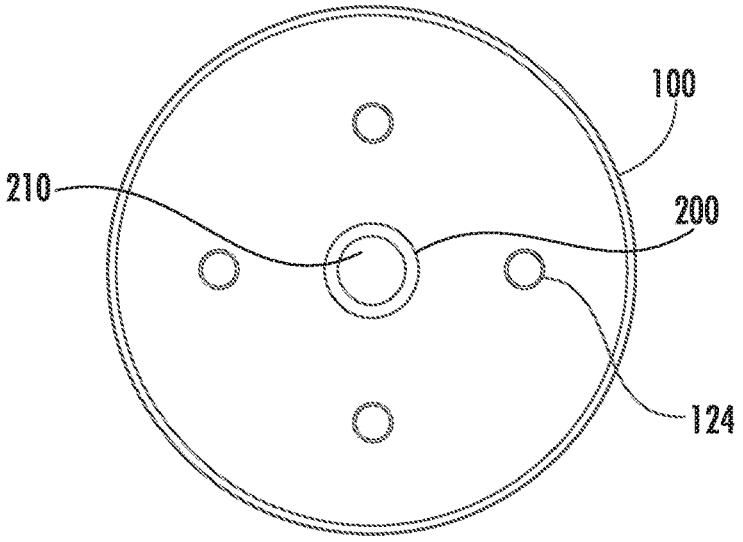
FIG. 6 is an end view of an exemplary bundled tube type fuel nozzle assembly, according to at least one embodiment of the present disclosure.
Figure 7:
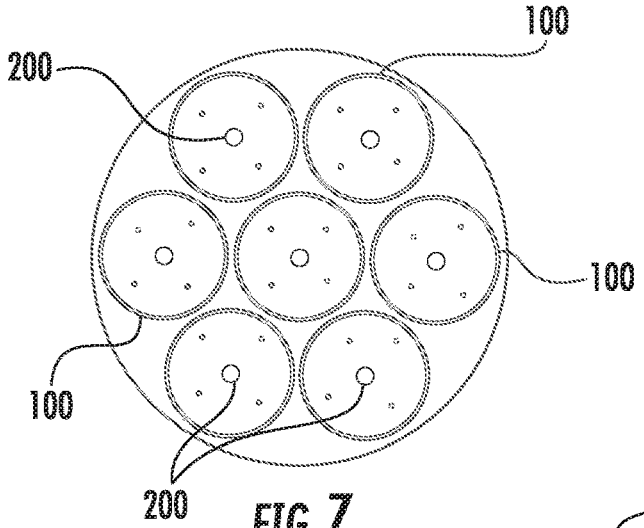
FIG. 7 is an end view of an exemplary bundled tube type fuel nozzle assembly, according to at least one embodiment of the present disclosure.
Figure 8:
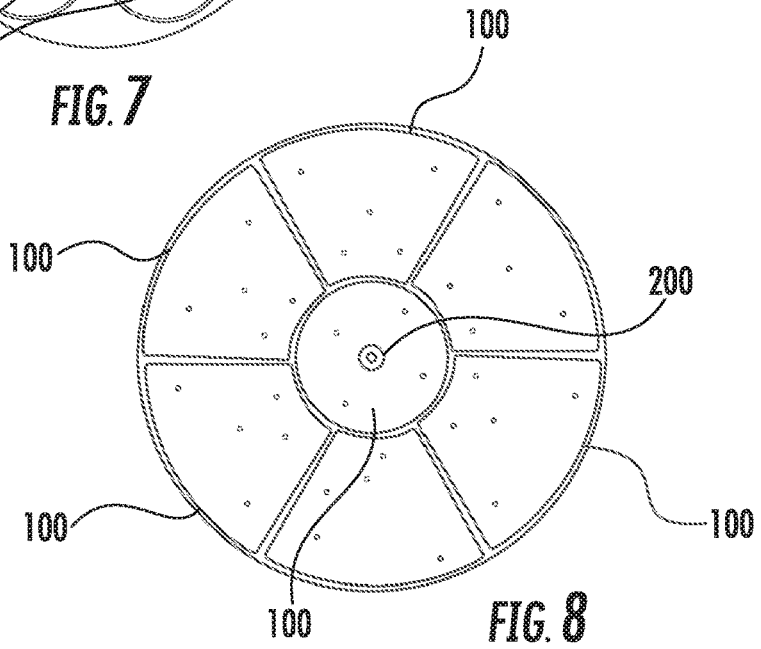
FIG. 8 is an end view of an exemplary bundled tube type fuel nozzle assembly, according to at least one embodiment of the present disclosure.

FIGS. 6, 7, and 8 provide various end views of one or more exemplary fuel nozzle assemblies 100 looking upstream from the combustion chamber 42. In some exemplary embodiments, e.g., as illustrated in FIG. 6, fuel nozzle assembly 100 may consist essentially of a single segment provided with the tubes 118 radially arranged across the entire cap plate 112. As shown in FIG. 6, the outlets 124 appear as circles radially outward of the axial centerline of the nozzle assembly 100. Also illustrated in FIG. 6, a single quarter-wave tube 200 may be provided, e.g., centered on centerline 46 of the combustor 16.

In some exemplary embodiments, e.g., as illustrated in FIG. 7, the fuel nozzle segments be arranged as six fuel nozzle segments surrounding a single fuel nozzle segment, wherein all of the segments are circular or rounded. In some embodiments, such as the exemplary embodiment illustrated in FIG. 7, each segment may have a quarter wave tube 200 associated therewith. FIG. 8 illustrates yet another exemplary embodiment including a combination of wedge-shaped and circular fuel nozzle segments. In some embodiments, for example as illustrated in FIG. 8, a single quarter-wave tube 200 may be provided in only one of the several segments.

One of ordinary skill in the art should understand that the present invention is not limited to any particular geometry of individual nozzles or nozzle arrangements or number of fuel nozzle segments, unless specifically recited. Additionally, various combinations of features from the illustrated example embodiments shown and described herein may be provided within the scope of the present subject matter. For example, different combinations of fuel segment shapes and the quarter-wave tubes 200 may be provided, e.g., some or all of the wedge-shaped segments of FIG. 8 may have the quarter-wave tubes 200 such as is illustrated in FIG. 4.

In the illustrated exemplary embodiments, the quarter-wave tube 200 is cylindrical with a single continuous side wall 206 extending between the entrance 210 and a plate defining the reflective plane 220. Additionally, in some embodiments, the cross-sectional shape of the quarter-wave tube 200 may vary, e.g., the quarter-wave tube 200 could be hexagonal, rectangular, oblong, annular, or any other suitable shape. For example, in some embodiments wherein the quarter-wave tube 200 is annular, the annular quarter-wave tube may extend around the fuel nozzle assembly 100 across multiple segments thereof.

Figure 10:
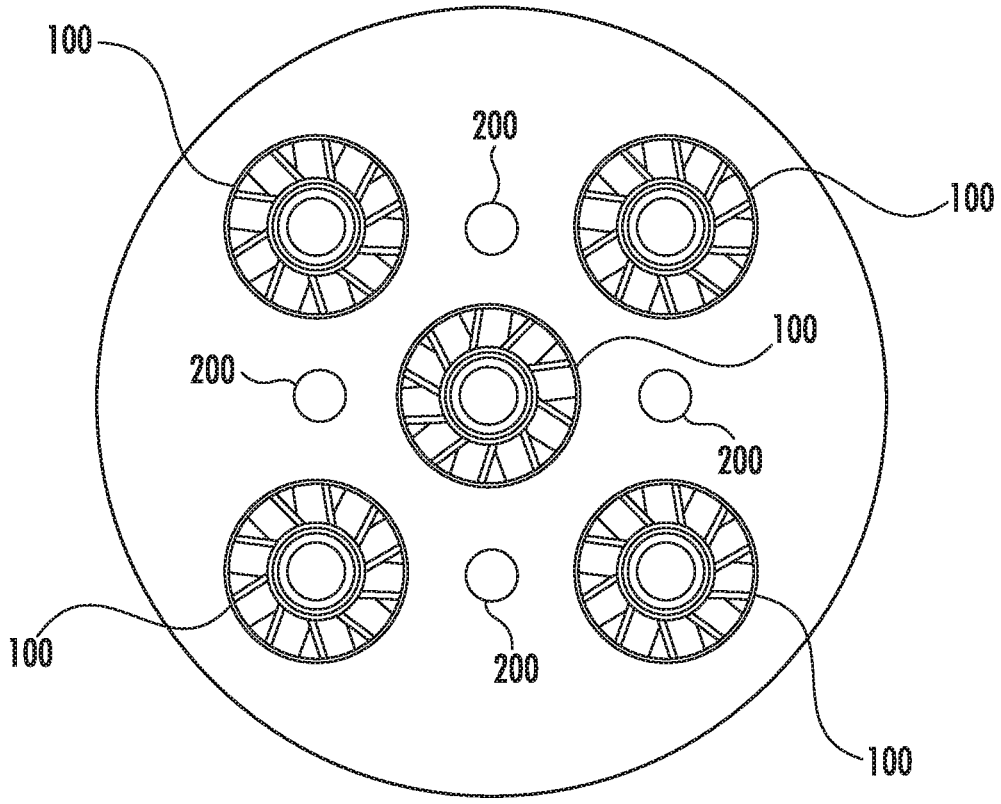
FIG. 10 is an end view of an exemplary fuel nozzle assembly, according to at least one embodiment of the present disclosure.
Figure 11:
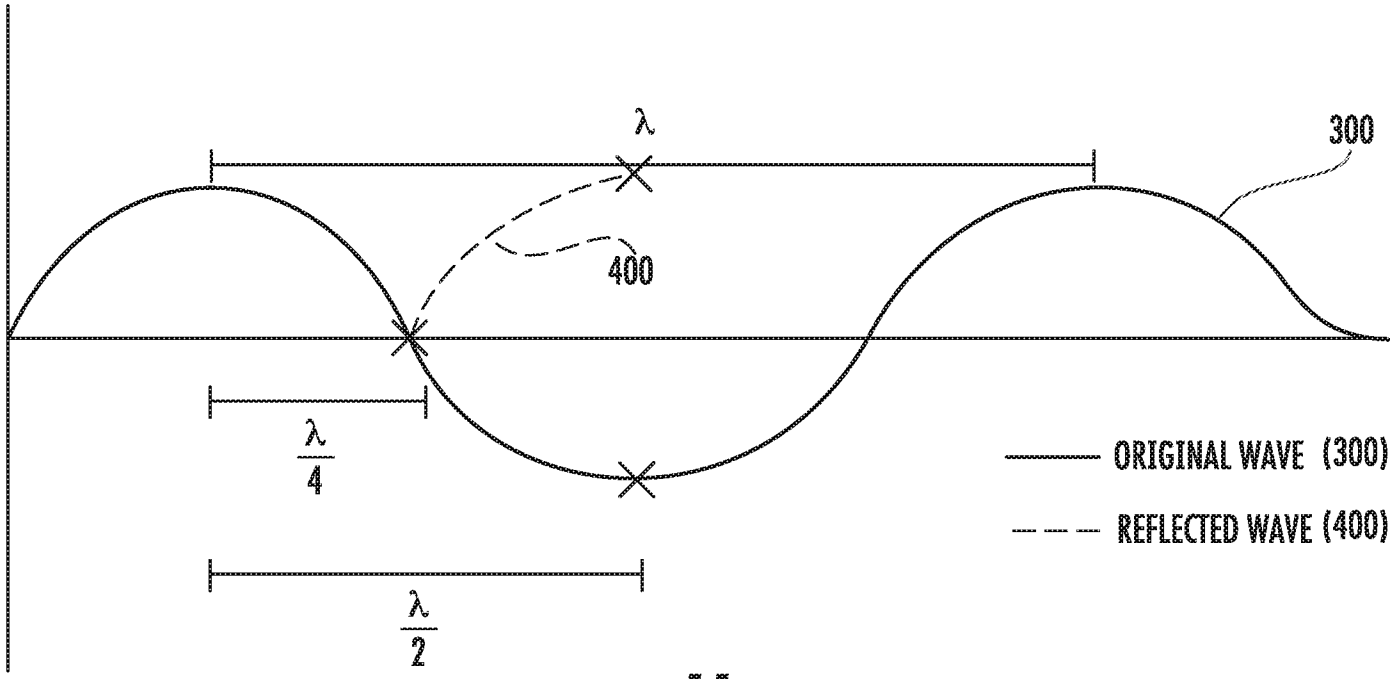
FIG. 11 is a graph of an exemplary wave pattern and resultant wave according to at least one embodiment of the present disclosure.

Finally, while reference has been throughout the present disclosure to the application of quarter-wave tubes in bundled tube fuel nozzle assemblies, it should be understood that the present quarter-wave tubes may be similarly employed on cap plates 112 supporting other types of fuel nozzles. For example, as illustrated in FIGS. 9 and 10, the fuel nozzles may be swozzles (swirled nozzles) 100. In this embodiment, the quarter-wave tubes 200 may be mounted between the fuel nozzles 100, rather than being incorporated within the fuel nozzles, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor comprising:

a plurality of wedge-shaped bundled tube fuel nozzles arranged in a circumferential array, each wedge-shaped bundled tube fuel nozzle comprising:

a fuel plenum body comprising a forward plate extending in a radial direction, an aft plate axially spaced from the forward plate and extending in the radial direction, an outer sleeve extending in an axial direction between the forward plate and the aft plate, and a fuel plenum defined by the forward plate, the aft plate and the outer sleeve;

a fuel conduit in fluid communication with the fuel plenum; and a plurality of mixing tubes extending through the fuel plenum body, each of the mixing tubes comprising an air inlet, a fuel port in fluid communication with the fuel plenum, and an outlet downstream of the aft plate;

the combustor further comprising an end cap having a circular shape, the end cap axially spaced from the aft plates of the plurality of wedge-shaped bundled tube fuel nozzles whereby an air plenum is defined between the aft plates and the end cap, the end cap upstream of a combustion zone, the end cap comprising a hot surface facing the combustion zone and an outer shroud that surrounds the plurality of wedge-shaped bundled tube fuel nozzles;

a plurality of quarter-wave tubes integrally formed with the end cap, the plurality of quarter-wave tubes extending from the hot surface of the end cap into the air plenum, each quarter-wave tube of the plurality of quarter-wave tubes corresponding to one of the wedge-shaped fuel nozzles, each quarter-wave tube extending along the axial direction from an entrance at an aft end of the quarter-wave tube to a reflective plane at a forward end of the quarter-wave tube;

wherein each quarter-wave tube defines an internal volume and the entrance of each quarter-wave tube permits unobstructed flow between the internal volume and the combustion zone;

wherein each quarter-wave tube comprises at least one purge hole defined in the forward end of the quarter-wave tube; and wherein the plurality of quarter-wave tubes consists of an array of quarter-wave tubes positioned equidistant from the center of the hot surface of the end cap and equally circumferentially spaced around the center of the hot surface of the end cap, wherein no two quarter-wave tubes of the combustor are colinear along a line extending along the hot surface through the center of the hot surface, and wherein each quarter-wave tube in the plurality of quarter-wave tubes is closer to the outer shroud than the center of the hot surface of the end cap.

2. The combustor of claim 1, wherein a length of each quarter-wave tube is defined by the distance between the entrance and the reflective plane.

3. The combustor of claim 2, wherein the length of each quarter-wave tube corresponds to about one-quarter of a wavelength of a predetermined frequency.

4. The combustor of claim 1, wherein the entrance of each quarter-wave tube is completely open to the combustion zone.

5. The combustor of claim 1, wherein the entrance of each quarter-wave tube is defined at the hot surface of the end cap.

6. The combustor of claim 1, wherein each quarter-wave tube is radially aligned with the fuel conduit of the corresponding wedge-shaped fuel nozzle and axially aft of the fuel conduit of the corresponding wedge-shaped fuel nozzle.

7. The combustor of claim 1, wherein the end cap and the plurality of quarter-wave tubes are manufactured as a singular component.

8. The combustor of claim 1, wherein the plurality of quarter-wave tubes is configured to dampen a frequency range from about 900 Hz to about 1.1 kHz.

9. The combustor of claim 1, wherein the outer shroud is a single cylindrically shaped outer shroud that surrounds all of the plurality of quarter-wave tubes.

10. The combustor of claim 1, wherein the outer shroud extends from the end cap beyond the reflective plane of each quarter-wave tube of the plurality of quarter-wave tubes to a flange.

11. A gas turbine, comprising:

a compressor;

a turbine;

a combustor disposed downstream from the compressor and upstream from the turbine, the combustor comprising:

a plurality of wedge-shaped bundled tube fuel nozzles arranged in a circumferential array and disposed upstream of a combustion zone, each wedge-shaped bundled tube fuel nozzle comprising:

a fuel plenum body;

a fuel plenum defined by the fuel plenum body;

a fuel conduit in fluid communication with the fuel plenum; and a plurality of mixing tubes extending through the fuel plenum body, each of the mixing tubes comprising an air inlet, a fuel port in fluid communication with the fuel plenum, and an outlet downstream of the fuel plenum body;

the combustor further comprising an end cap having a circular shape, the end cap axially spaced from the fuel plenum bodies of the plurality of wedge-shaped bundled tube fuel nozzles whereby an air plenum is defined between the fuel plenum bodies and the end cap, the end cap upstream of the combustion zone, the end cap comprising a hot surface facing the combustion zone and an outer shroud that surrounds the plurality of wedge-shaped bundled tube fuel nozzles;

a plurality of quarter-wave tubes integrally formed with the end cap, each quarter-wave tube of the plurality of quarter-wave tubes extending axially upstream from the end cap from an aft end to a forward end, each quarter-wave tube of the plurality of quarter-wave tubes corresponding to one of the wedge-shaped bundled tube fuel nozzles;

wherein each quarter-wave tube comprises an entrance at the aft end and a reflective plane at the forward end;

wherein each quarter-wave tube defines an internal volume and the entrance of each quarter-wave tube permits unobstructed flow between the internal volume and the combustion zone;

wherein the quarter-wave tube comprises at least one purge hole defined in the forward end of the quarter-wave tube; and wherein the plurality of quarter-wave tubes consists of an array of quarter-wave tubes positioned equidistant from the center of the hot surface of the end cap and equally circumferentially spaced around the center of the hot surface of the end cap, wherein no two quarter-wave tubes of the combustor are colinear along a line extending along the hot surface through the center of the hot surface, and wherein each quarter-wave tube in the plurality of quarter-wave tubes is closer to the outer shroud than the center of the hot surface of the end cap.

12. The gas turbine of claim 11, wherein a length of each quarter-wave tube is defined by the distance between the entrance and the reflective plane.

13. The gas turbine of claim 12, wherein the length of each quarter-wave tube corresponds to about one-quarter of a wavelength of a predetermined frequency.

14. The gas turbine of claim 11, wherein the entrance of each quarter-wave tube is completely open to the combustion zone.

15. The gas turbine of claim 11, wherein each quarter-wave tube extends through the end cap such that the entrance of each quarter-wave tube is flush with the hot surface of the end cap.

16. The gas turbine of claim 11, wherein each quarter-wave tube is radially aligned with the fuel conduit of the corresponding wedge-shaped bundled tube fuel nozzle and axially aft of the fuel conduit of the corresponding wedge-shaped bundled tube fuel nozzle.

* * * * *